United States Patent [19]

Universe

[11] Patent Number: 4,624,396

[45] Date of Patent: Nov. 25, 1986

[54] GARMENT HANGER

[76] Inventor: Samy F. Universe, 12300 Sherman Way, North Hollywood, Calif. 91605

[21] Appl. No.: 791,984

[22] Filed: Oct. 28, 1985

[51] Int. Cl.[4] ..... A41D 27/22

[52] U.S. Cl. ..... 223/92; 223/86; 223/DIG. 4; 206/281; D6/316; 40/322

[58] Field of Search ..... 223/86, 88, DIG. 4, 223/92, 85, 89–97, DIG. 1; 206/279, 281, 284, 288; D6/316–319; 40/322

[56] References Cited

U.S. PATENT DOCUMENTS

| | | | |
|---|---|---|---|
| D. 253,448 | 11/1979 | Salladay | D6/319 |
| 1,593,285 | 7/1926 | Batts | 223/88 |
| 2,187,535 | 1/1940 | Aljian | 40/322 X |
| 2,489,866 | 11/1949 | Darmenstein | 223/86 |
| 2,575,089 | 11/1951 | Black | 40/322 X |
| 2,596,745 | 5/1952 | Waldman | 223/88 |
| 3,052,390 | 9/1962 | Gingher | 223/88 |
| 3,733,016 | 5/1973 | Rood | 223/86 |

*Primary Examiner*—Werner H. Schroeder
*Assistant Examiner*—Andrew M. Falik
*Attorney, Agent, or Firm*—Elliott N. Kramsky

[57] ABSTRACT

A garment hanger provides both ease of carriage of a heavy and/or bulky garment and significant aesthetic opportunities. A hook is flexibly engaged to the hanger body by means of a ball-and-socket joint formed by a spherical male element associated with the hook and an ellipsoidal female cavity associated with the hanger body. The hanger body includes transversely oriented means for engaging an ornamental sign. The molded plastic of the hanger is readily adapted to impregnation with selected volatile agents and/or ornamentation. Alternatively, an elongated cavity may be provided in a lower transverse member of the hanger body for accommodating preselected elements.

3 Claims, 7 Drawing Figures

FIG. 1
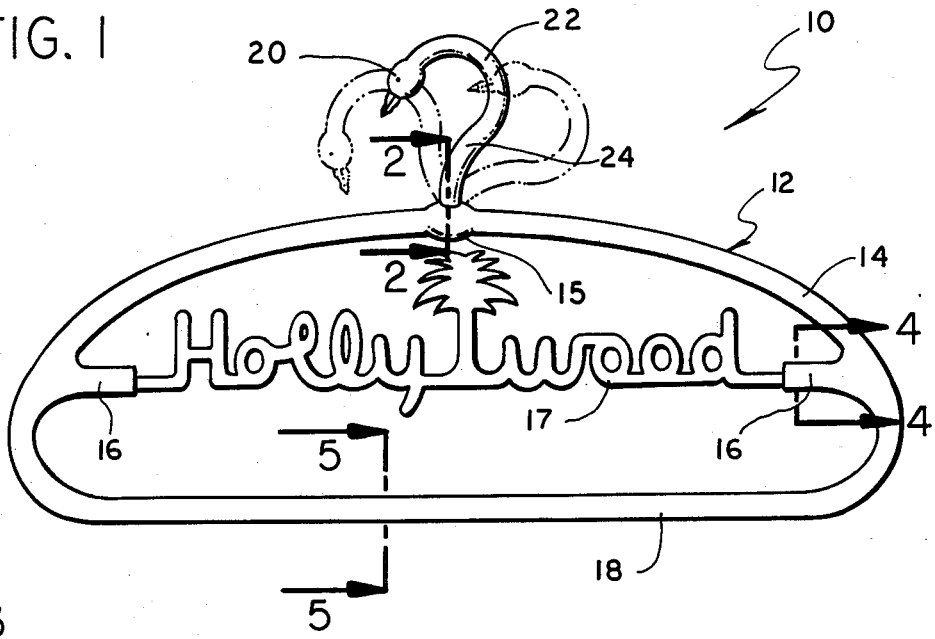
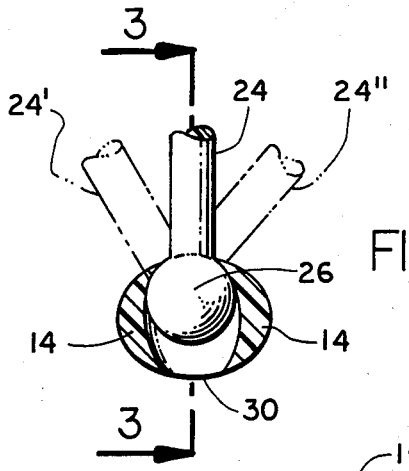
FIG. 2
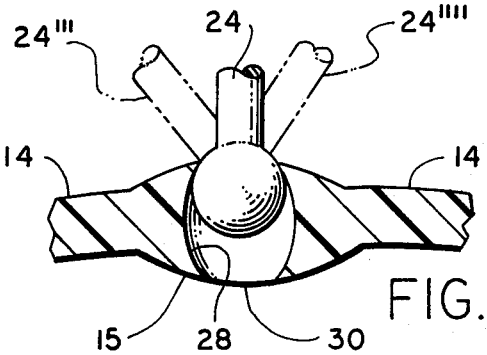
FIG. 3
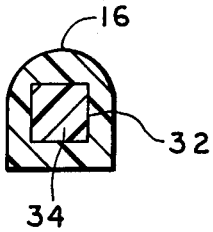
FIG. 4
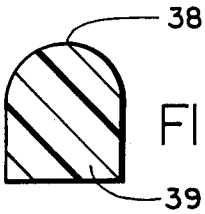
FIG. 5
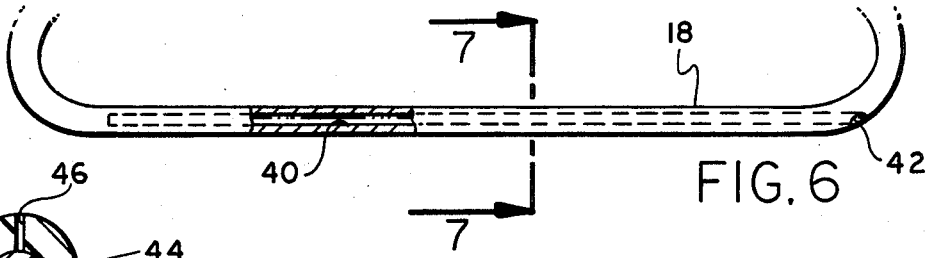
FIG. 6
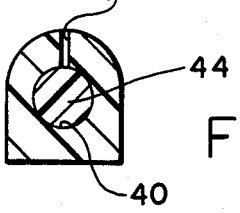
FIG. 7

GARMENT HANGER

BACKGROUND

1. Field of the Invention

The present invention relates to garment hangers. More particularly, this invention pertains to a hanger that offers ease of handling when encumbered with one or more heavy coats or the like while also providing aesthetic features.

2. Description of the Prior Art

The coat or garment hanger design art has witnessed numerous innovations. The basic hanger comprises a hook for engaging a conventional closet pole and a body that is generally transverse to the axis of the hook for supporting the garment in a manner similar to that in which it is suspended from the shoulders of a wearer.

Numerous innovations have been realized in this and related arts. Representative technology is disclosed in the following United States patents (identified by serial number, inventor and title):

- U.S. Pat. No. 2,489,866 of Damenstein for "Coat Hanger";
- U.S. Pat. No. 1,168,741 of Potter for "Garment Hanger";
- U.S. Pat. No. 2,417,397 of McCarthy for "Hanger";
- U.S. Pat. No. 3,790,044 of Verdile for "Garment Hangers";
- U.S. Pat. No. 3,733,016 of Rood for "Clothes Hanger Attachment";
- U.S. Pat. No. 2,488,860 of Gentile, et al. for "Coat Hanger";
- U.S. Pat. No. 2,398,873 of Ward for "Attachment for Coat Hangers"; and
- U.S. Pat. No. 3,698,974 of Raubisser, et al. for "Process for the Manufacture of Apparatus for Emitting of Insecticidal Vapors".

British patent specification 290,579 of Dumesnil for "Garment Support" and patent Ser. Nos. 841 048 and 847 060 of the Federal Republic of Germany are likewise representative of the existing state of the art.

The manner in which a heavy coat is arranged on a conventional hanger is unsuitable for comfortable transport of the garment. Unfortunately, short business trips often necessitate that a suit, for example, be carried onto an airplane by the traveler. Travelers are frequently sighted in airports carrying, for example, a suit suspended from a hanger within a covering garment bag. The only readily available means for holding the garment bag is often the protruding hook of the hanger. The prior art teaches a relatively inflexible relationship between the hook and the body of the hanger. As a result, substantial torsion force can be transmitted to the hook, and, thence, to the hand, fingers and wrist of the traveler. Such force may be sufficient to cause punctures, sprains and annoying discomfort. Further, the stresses exerted often cause the traveler to stop and release the garment bag at regular intervals, complicating an often frantic rush to the assigned boarding gate.

SUMMARY OF THE INVENTION

The present invention addresses the foregoing and other shortcomings of the prior art by providing, in a first first aspect, an improved and novel garment hanger. The inventive garment hanger represents an improvement over the existing state of the art in which hangers often include a hook for suspending the hanger and a hanger body engaged thereto. In accordance with this invention, the hook includes a male element. It is further provided according to the hanger of the invention that the body includes a mating female element. The aforesaid male and female elements are arranged so that the hook is movable with respect to the body of the hanger about at least two orthogonal axes.

In a further aspect, the present invention provides a novel garment hanger that includes a hook, a hanger body, and an ornamental sign. The hanger body includes generally transversely-arranged upper, mid- and lower members, and the mid-member includes means for engaging the sign.

The preceding and additional aspects and features of this invention will become further apparent from the detailed written description that follows. This description is accompanied by a set of drawing figures that includes numerals, corresponding to numerals of the written description, for referencing the features of the invention. Throughout the written description and the illustrations, like numerals refer to like features.

BRIEF DESCRIPTION OF THE DRAWINGS

FIG. 1 is a front elevational view of a garment hanger in accordance with the invention;

FIG. 2 is an enlarged partial cross-sectional view, taken at line 2—2 of FIG. 1, showing in detail the mating male and female elements for engaging the hook to the body of the hanger of the invention;

FIG. 3 is an enlarged partial cross-sectional view of the mating male and female elements taken at the line 3—3 of FIG. 2;

FIG. 4 is a cross-sectional view taken at the line 4—4 of FIG. 1 that provides a detailed view of the means for engaging an ornamental sign to the garment hanger of the invention;

FIG. 5 is a cross-sectional view of the lower member of the integral hanger body taken at line 5—5 of FIG. 1;

FIG. 6 is a partially-broken side elevation view of the lower member in accordance with an alternative embodiment of the invention; and FIG. 7 is a cross-sectional view of the lower member in accordance with the alternative embodiment taken at line 7—7 of FIG. 6.

DETAILED DESCRIPTION

Turning now to the drawings, FIG. 1 is a front elevation view of a garment hanger in accordance with the invention. The inventive apparatus generally includes a hook 10 and a body 12 cooperatively engaged thereto. As will be seen below, the particular manner of engagement of the hook 10 to the body 12 permits a greater degree of relative movement therebetween than is known in the prior art. The manner by which this significant and useful advance is achieved constitutes a significant feature of the invention.

The body, preferably formed of molded resilient plastic or like material, includes three major, generally transversely-oriented members. An upper or coat-bearing member 14 includes a symmetrical pair of downwardly-sloping arms joined at a central socket casing 15. At their opposed ends, the downward-sloping arms that form the member 14 are moldably joined to the ends of a mid- or ornamental sign locating member 16 and a lower or trouser-bearing member 18.

As is shown in FIG. 1, an ornamental sign 17 is fixably attached to the body 12 at the sign-locating member 16. The sign 17 may comprise pure ornamentation, an incidium or a combination thereof, providing a useful advantage of the invention. The manner in which the sign 17, or a like sign, is attached to the hanger is discussed below with particular reference to FIG. 4.

The hook 10 includes a swan head 20 or like ornamentation. The head 20 is integral with a highly curved portion 22 for engaging a pole of the type commonly arranged transversely within a clothes closet, a wardrobe or the like. A bottom, generally arcuate portion 24 is additionally formed with the portion 22 so that the hook 10 comprises a single unitary structure. As is the case of the body 12, the hook 10 is preferably molded of resilient plastic or the like. However, other materials will be readily understood to be appropriate substitutes therefor including wood, metal and like rigid and semi-rigid materials.

FIG. 2 is an enlarged partial cross-sectional view taken at the line 2—2 of FIG. 1. This view is illustrative of the advantageous ball-and-socket structure utilized for engaging the hook 10 and the body 12 of the invention. As can be seen in this figure, the bottom 24 of the hook 10 terminates at an enlarged spherical portion 26.

The spherical portion 26 is adapted to be secured within a vertically-oriented, ellipsoidal cavity 28 formed within the central socket casing 15 of the coat-bearing member 14. The bottom of the cavity 28 is open by an aperture 30 at the underside of the member 14. An aperture at the top of the cavity allows the hook 10 to protrude therethrough. The combination of the ellipsoidal shape of the cavity 28 and the underside aperture 30 in communication therewith allows the hook 10 to be disengaged from the body 12 when desired. Such removal may be advantageous when storing one or more garments flat within a garment bag or other container.

FIG. 3 is an enlarged cross-sectional partial elevation view of the joint for engaging the hook 10 and the body 12 taken at line 3—3 of FIG. 2. Taken together, FIGS. 2 and 3 present orthogonal representations of the range of motion between the hook 10 and the body 12 that is permitted by the unique ball and socket joint of the invention. In FIG. 2, the shadow positions 24' and 24'' demonstrate the range of motion of the bottom portion 24 of the hook 10, nearly one hundred and eighty degrees, that is permitted in a direction perpendicular to the plane of the body 12. The shadow positions 24''' and 24'''' show that a like range of motion is permitted within the plane of the body 12 by the very same joint. While FIGS. 2 and 3 demonstrate movements along orthogonal axes, it will be readily appreciated that, in accordance with the general symmetry of the ball and socket joint that includes the enlarged captured spherical portion 26 and the ellipsoidal cavity 28, movements comprising vectorial combinations of the two orthogonal axes are clearly also possible. The locus of all such possible movements or deflections of the orientation of the hook 10 relative to the body 12 comprises a solid cone described by the bottom portion 24 having its apex at the spherical portion 26.

The relative movement permitted between the hook 10 and the body 12 is advantageous both when transporting a garment and during storage. Often, when one desires to carry a garment that is suspended from a garment hanger (possibly within a garment bag), the relatively fixed relationship between the position of the hook and the body of the hanger results in the transmission of substantial force to the fingers of the user holding the hook 10. Such force is generated by the weight of the suspended coat. The geometry of the conventional hanger not only transmits an unavoidable weight-force but also causes and transmits torsional forces that can be quite unpleasant. The present invention, by allowing substantially greater freedom of movement between the body 12 and the hook 10 and an infinite number of axes of inclination therebetween, substantially eliminates the effects or torsional forces by supporting, and therefore transmitting, none of this force. The user need be concerned only with the weight-force of the garment. The effects of this force are more easily accommodated and less injurious to the user.

FIG. 4 is a cross-sectional view taken at the line 4—4 of FIG. 1. This view shows in detail the arrangement of one of the square peg-like tongue and groove joints for securing the opposed ends of the ornamental sign 17 to the doubly-truncated mid-member 16 of the hanger body 12. A peg-like substantially square peg 34 at an end of the ornamental sign 17 comprises a male member 34 for interlocking with a similarly-shaped hollowed portion 32 interior of the member 16.

A square or other regular (non-round) shape is selected for the cross section of the male peg 34. Such a shape offers resistance to rotation of the sign 17 about the axis of the member 16. Further, by choosing a convention, regular shape, numerous signs, in the form of preselected inserts, may be manufactured for insertion onto the garment hanger of the invention. One may desire to employ this feature of the invention to vend a hanger without any sign 17. Rather, the purchaser would then be free to adapt the hanger to its particular advertising and/or novelty item requirements by engaging a suitable sign formed with appropriate dimensions and having "standardized" opposed ends for engaging the hollowed portions (such as that shown at 32) of the sign location member 16.

FIG. 5 is a cross-sectional view of the lower member 18 of the hanger body 12 taken at the line 5—5 of FIG. 1. As is shown, the upper surface 38 of the member 18 is rounded, giving the shape a generally convex aspect. The smooth, rounded surface 38 allows one to hang a garment, such as a pair of trousers, in a manner that is well-known in the art.

The cross section of FIG. 5 comprises a solid homogeneous mass of material 39. This is to be contrasted with the alternative embodiment illustrated in FIGS. 6 and 7 below. Insofar as the construction shown in FIG. 5 is concerned, the material 39 of the lower member 18, as well as that of the rest of the body 12, might advantageously consist of a resilient plastic impregnated with one or more of a number of substances for effecting a particular beneficial purpose. As was mentioned above, the material might consist of a plastic impregnated with a vaporous, volatile constituent for emitting a pleasurable odor that is readily absorbed into the suspended garment(s). Alternatively, the plastic could be impregnated with a volatile insecticide. A further adaptation might include one of a number of luminous materials. When the plastic of the hanger is thus impregnated, a "glow in the dark" effect results. Finally, the plastic could be impregnated with a material that might give the hanger a "glitter" appearance.

FIG. 6 is a partially broken side elevation view of the lower member 18 in accordance with the above-referenced alternative embodiment of the invention. As is seen in this embodiment, an elongated transverse aperture 40 is located interiorly of the lower member 18. The aperture is semi-closed within the member 18, defining an elongated cavity, with an aperture 42 providing an outlet to the surface of the lower member 18. The accessible cavity allows one to place an appropriate cylindrical element 44 (shown in FIG. 7) of volatile aromatic or pest-resistant material within the hanger body 12 so that like results to those described in connection with the prior embodiment may be achieved without the use of specially-prepared, impregnated plastics.

The detailed arrangement for achieving the desired results in accordance with the alternative embodiment is shown in FIG. 7, a cross-sectional view of the lower member 18 taken at the line 7—7 of FIG. 6. As shown, the desired volatile agent is vented upwardly by means of a vertical longitudinal slot 46 in the member 18.

Thus, there has been provided to the relevant art a new and improved garment hanger. By employing the teachings of this invention, one realizes numerous beneficial results not heretofore achieved. Such advantages enhance the comfortable portability of garments, the ready availability of the apparatus for adding preselected ornamentation and the creation of numerous ancillary effects for enhancing the appearance of the hanger, its suitability for storage of pest endangered clothing materials and the addition of aromatic effects.

While this invention has been described with reference to its presently preferred embodiments, it is by no means so limited. Rather, its scope is measured with reference to the set of claims that follows and includes all equivalents thereof.

What is claimed is:

1. A garment hanger comprising, in combination:

(a) a hook;
(b) a hanger body;
(c) an ornamental sign, said sign including opposed protruding members, each of said male members having a predetermined cross section;
(d) said hanger body including generally transversely-arranged upper, mid- and lower members;
(e) said mid-member including an open central portion for accommodating said ornamental sign; and
(f) said mid-member further including cavities of said predetermined cross section for engaging said male members of said ornamental sign.

2. A garment hanger comprising, in combination:

(a) a hook;
(b) a hanger body;
(c) an ornamental sign, said sign including opposed protruding square male members;
(d) said hanger body including generally transversely-arranged upper, mid- and lower members;
(e) said mid-member including an open central portion for accommodating said ornamental sign; and
(f) said mid-member further including square cavities for engaging the square male members of said sign.

3. A garment hanger comprising, in combination:

(a) a hook;
(b) a hanger body;
(c) said hanger body including generally transversely-arranged upper, mid- and lower members, and
(d) an ornamental sign located within said mid-member.

* * * * *